US005794498A

United States Patent [19]

Chaloux

[11] Patent Number: 5,794,498

[45] Date of Patent: Aug. 18, 1998

[54] IN-SITU METHOD AND APPARATUS FOR BLOCKING LENSES

[75] Inventor: Leonard E. Chaloux, Keene, N.H.

[73] Assignee: Taylor Hobson Limited, England

[21] Appl. No.: 325,818

[22] Filed: Oct. 19, 1994

[51] Int. Cl.[6] ..... B24B 5/02

[52] U.S. Cl. ..... 82/1.11; 451/28

[58] Field of Search ..... 451/42, 5, 8, 57; 82/1.11

[56] References Cited

U.S. PATENT DOCUMENTS

| | | | |
|---|---|---|---|
| 4,210,038 | 7/1980 | Hill | 451/256 |
| 4,409,760 | 10/1983 | Nagaura | 451/42 |
| 4,460,275 | 7/1984 | Spriggs | 451/42 |
| 5,080,482 | 1/1992 | Benz et al. . | |
| 5,205,076 | 4/1993 | Vernon et al. | 451/218 |
| 5,272,818 | 12/1993 | Youden et al. . | |

FOREIGN PATENT DOCUMENTS

| | | |
|---|---|---|
| 0 023 800 A2 | 2/1981 | European Pat. Off. . |
| 0 141 541 A2 | 5/1985 | European Pat. Off. . |

*Primary Examiner*—Robert A. Rose

*Attorney, Agent, or Firm*—Lerner, David, Littenberg, Krumholz & Mentlik

[57] ABSTRACT

A blocking technique and apparatus are used to mount a partially finished lens or other component to an arbor, which is useable to hold the partially finished lens for subsequent machining or mechanical operations. The blocking of the partially finished lens occurs on the same axes of the multi-axis machining device that were used to generate the partially finished lens. The blocking of the partially finished lens occurs without removing the partially finished lens from the workpiece holder which held the partially finished lens during the machining operation. Accurate and repeatable blocking is achieved using the axes of the lens generating equipment.

15 Claims, 6 Drawing Sheets

IN-SITU METHOD AND APPARATUS FOR BLOCKING LENSES

BACKGROUND OF THE INVENTION

The present invention relates generally to the precision machining of optics and like articles, and more particularly to a method and apparatus for accurately mounting a partially or fully machined optic or like part on a removeable tool (such as an arbor), which can be used in subsequent machining operations.

For purposes of clarity, the words "machine" or "machining" will be used to describe, where appropriate in context, any mechanical operation on a workpiece, including surface altering operations (cutting, polishing, etc.) and assembly of the workpiece, measuring the workpiece or other minor mechanical operations. Also, as used herein, the term "lens" shall refer to any optical component or article including but not limited to spherical, toric and aspheric designs, precision molds, fine ceramics or other complex mechanical components which, because of their specific applications and uses, require close tolerances in all dimensions.

Articles of the type referred to above require machining on ultra precision devices. Multi-axis devices are often employed since they provide a very high degree of the requisite precision. The precision machining of a workpiece on a multi-axis lathe, grinder or other machining device ("a lens generating machine") thus includes the controlled and relative movement of the workpiece, held in a workpiece holder, and the tool, held in a toolholder. Typically, the workpiece holder and the toolholder are mounted on moveable supports which facilitate precise movement of the workpiece and tool, based on the location of the workpiece and the tool. The location of the workpiece and tool are often identified in relation to the axes of the device, which can be linear or rotary. It is the precise movement along the axes and the known locations of the workpiece and tool which provide the requisite accuracy.

Described and shown herein, for illustrative purposes only, is a two-axis lathe. It includes a Z-axis on which a spindle rotates a collet (workpiece holder) and a lens blank (a cylindrical button-like workpiece). These components are moveable along the Z-axis, and the rotational axes of these components are coincident with one another. Transverse to the Z-axis is an X-axis which carries at least one toolholder and cutting tool which are moveable along the X-axis. The Y component of the X-Z two-axis lathe is perpendicular to the X and Z axes, and is also taken into consideration when setting (ascertaining) the position of the various components. In use, the tool is moved in a horizontal plane along the workface of the lens blank through coordinated motions of the various machine axes. Typically, the tool sweeps across the workface of the workpiece from the outer perimeter inwardly to the center of the workpiece, which is considered the zero position or apex of the workpiece. In other words, at the center of the workpiece, the tool is usually at 0—0 coordinates on the X-Z axes. As can be appreciated, the operating system, most likely a computer for numerically controlling the movement of the lathe components, provide the X and Z coordinate points for positioning the workpiece and cutting tool.

Often, the precision machining in the above manner does not result in a finished piece. It may be that only one side of the product has been machined, and the side of the workpiece opposite to the machining tools must also be completed. For instance, in the formation of contact lenses, the machining tools in the above operation may complete the concave side (the base curve) and edges of the contact lens, but leave untouched the convex side (the power curve) of the contact lens. Alternatively, if the machining results in a finished piece, subsequent mechanical operations, such as assembly with another part or measurement, may also require that critical parameters of the piece be known. Thus, the workpiece becomes either a partially finished part requiring further machining or an essentially finished part requiring only assembly or another minor mechanical operation. (As used herein, the term "previously generated lens" will encompass both of these type of machined parts.) In any event, the previously generated lens must be removed from the workpiece holder and its critical parameters—normally the optical axis and apex—must be accurately located so that the previously generated lens can be properly held for subsequent operations.

The previously generated lens is thus mounted on a dedicated blocking device, which is used to hold the previously generated lens while subsequent machining or other mechanical operations are being performed. The process of mounting a previously generated lens on a blocking device is known as "blocking" the workpiece. When blocking a workpiece, it is necessary to accurately align the previously generated lens to the blocking device. In most cases, this means to maintain the axis of the previously generated lens coincident to the axis of other surfaces to be machined on the other side of the lens blank. In the case of contact lenses, this axis is the optical axis about which the concave surface and other aspects of the lens were generated. In addition to this alignment, it may also be important to position a particular point on the previously generated lens at a known distance from a reference point on the blocking device. (On a contact lens, this point is the apex of the base curve.) This permits maintenance of not only the axis of the previously generated lens, but also other parameters of the previously generated lens. In the case of a contact lens, knowing the position of the apex permits control of the center thickness of the lens in subsequent operations.

Several blocking techniques have been used in the past. One such technique is known as spin or dynamic blocking. Using this technique, a workpiece is mounted on an arbor by a bonding material, and before the bonding material sets, the workpiece and arbor are rotated. During spinning and before the setting of the bonding material, the workpiece is forced by a tool or a finger until the centerline of the workpiece and the centerline of the arbor appear to be concentric. Another technique is known as static blocking, in which a reference diameter is cut about the workpiece, leaving a flange surface extending around the reference diameter. Subsequent mechanical alignment is obtained in a separate fixture which includes a hole sized to the reference diameter. The workpiece is placed into this fixture with the reference diameter in the corresponding hole, whereby the workpiece rests on the flange surfaces about the reference diameter. At least the tip of the arbor includes a diameter which also fits in the hole in the fixture, and it is inserted from the underside of the fixture to meet the workpiece. Yet another blocking technique is known as optical static blocking, in which a partially finished lens is moved from the workpiece holder on the spindle to another workpiece holder, and the optical axis of a partially finished lens is detected by an optical microscope or similar device to position the lens on the arbor.

U.S. Pat. No. 5,080,482 to Benz et al. generally describes and illustrates the basic manner in which a previously generated lens is blocked. Generally, a blank of plastic is machined to form a finished concave lens surface. That partially finished lens is transferred to a block in such a way that the axis of the lens is aligned with the axis of the block and the apex of the lens is positioned a known distance from a reference point on the block. Wax or cement is used to temporarily fix the partially finished lens to the block so that the lens can undergo subsequent machining or mechanical operations.

The Benz patent seeks to overcome what it characterizes as the time consuming and difficult nature of manually positioning a partially finished lens during the blocking procedure by employing an optical static blocking technique. The Benz patent thus discloses the use of video images, digitizing processes and mathematical algorithms to properly align and position the optical axis of the lens on a blocking device. To accomplish this alignment and positioning, Benz teaches the removal of the partially finished lens (which includes the finished base curve surface) from the lens generating machining, and placing the same in a fixture attached to the X-Y part of an X-Y-Z micron stage. A blocking device is provided on the Z part of the X-Y-Z micron stage. This X-Y-Z micron stage is an entirely separate apparatus from the lens generating machine (which itself is a complex multi-axis device). The Benz approach then uses the camera image to find the optical axis of the partially finished lens and align the same with the blocking device. Following alignment, the partially finished lens is then mounted to the blocking device.

Each of the above blocking techniques contemplates blocking on an apparatus remote from the lens generating machine. In each case, the partially finished lens or workpiece must be removed from the workpiece holder on the lens generating machine and moved to a separate blocking apparatus. This off-machine blocking is time consuming because of the additional steps in the process, expensive because of the additional machinery and production time, often sacrifices accuracy because of the mechanical alignments required in many of the prior blocking techniques, and requires additional machining operations to take place on the lens generating machine (e.g., creation of a reference diameter line to facilitate mounting of the previously generated lens on a separate fixture).

In addition, upon blocking a previously generated lens, prior techniques do not know the wax or cement thickness between the previously generated lens and the blocking device. Accordingly, a further process must be undertaken in an attempt to avoid inconsistent center thickness or edges that are out of concentricity. This process often includes probing the lens, known as surface probing, in an attempt to identify the position of the partially finished lens. Again, additional time, expense and machinery is required.

The present invention provides a technique and an apparatus by which a previously generated lens can be accurately blocked without the need for a blocking station separate from the lens generating machine. The present invention thus eliminates the expense and time associated with a separate blocking apparatus, as well as eliminating machining operations sometimes necessary merely to facilitate subsequent off-machine blocking.

SUMMARY OF THE INVENTION

It is an object of the present invention to eliminate or minimize the disadvantages of prior blocking techniques by blocking a previously generated lens on the lens generating machine. Such on-machine blocking utilizes the inherent accuracies of the lens generating machine to set up the alignment of the previously generated lens to the mounting arbor.

It is another object of the present invention to use the axes of the lens generating machine to position a blocking device relative to a previously generated lens surface generally within the positioning accuracy of the lens generating machine's axes. Thus, the same axes used to generate the previously generated lens are also used to align the same during the blocking procedure.

It is another object of the present invention to provide a blocking technique and apparatus which provide for immediate blocking of a previously generated lens on the lens generating machine prior to removal of the previously generated lens from the workpiece holder, recognizing that this may occur with or without alignment or with minimal alignment of a previously generated lens with the blocking device, since some components may not require alignment at all or only require minimal alignment.

Another object of the present invention is to provide a blocking fixture at a known or determinable position relative to the position of the workpiece holder and the previously generated lens.

Another object of the present invention is to provide for the alignment of the previously generated lens with a blocking arbor prior to blocking the previously generated lens on the arbor.

Another object of the present invention is to provide a blocking technique and apparatus which permit the accurate positioning of a point of a previously generated lens relative to a reference point on a blocking arbor so that subsequent machining or mechanical operations can be appropriately controlled. In the case of contact lenses, it is the apex of the contact lens which is positioned at a predetermined distance from a reference point on a blocking arbor during the blocking procedure, such that the center thickness of the lens can be precisely controlled in subsequent operations.

Another object of the present invention is to provide a blocking technique and apparatus which can be used on lens generating machines having configurations with more than one axis of motion. This includes, but is not limited to, two axis contouring lathes and grinders, three of four axis lathes and grinders with R-theta type rotary motions combined with other linear axes, and other multi-axis lathes, mills, grinders and polishers.

Another object of the present invention is to provide a blocking technique and apparatus which has particular application in the field of manufacturing contact lenses and intraocular lenses, but is not limited to these applications, since the principles of the present invention may be applied to the manufacture of other types of lenses, optics or similar articles requiring close tolerances in all dimensions.

Another object of the present invention is to provide an accurate and repeatable blocking technique whereby the blocking cycle, which follows the part-cutting cycle, can be completed in a relatively rapid manner.

Another object of the present invention is to provide a blocking fixture having an adjustable and locking endstop to permit use of arbors of different lengths.

Another object of the present invention is to provide a blocking technique and apparatus in which the set-up procedures used to set the cutting tools of a lens generating machine can also be used to set up the initial position of the blocking fixture.

Another object of the present invention is to provide a blocking fixture which is mountable on a lens generating machine and requires little space on the lens generating machine.

Another object of the present invention is to provide a blocking technique and apparatus in which the blocking cycle may be included within the part-cutting cycle, or run separately from the part-cutting cycle.

Another object of the present invention is to provide a blocking technique and apparatus by which the thickness of the wax or cement used to facilitate the blocking of a previously generated lens can be maintained to any uniform thickness, thereby setting the apex of the previously generated lens at a desired position relative to a reference point on the arbor.

Another object of the present invention is to provide a blocking technique and apparatus which can be accomplished automatically, for instance, through software controlling the blocking cycle after the part cutting cycle.

In accordance with one embodiment of the present invention, a blocking technique includes the steps of providing a machining device having a workpiece holder, a toolholder and a lens-blocking device, the toolholder being moveable along a first axis, a lens-blocking being moveable along a second axis and the workpiece holder being moveable along a third axis which can traverse the first axis and the second axis, moving the workpiece holder and toolholder relative to one another so that a tool held by the toolholder machines a workpiece held by the workpiece holder to form a previously generated lens, and moving the workpiece holder and lens-blocking device relative to one another so that the previously generated lens becomes mounted to the lens-blocking device. The mounting step may be accomplished prior to releasing the previously generated lens from the workpiece holder. Preferably, the technique also includes the step of releasing the previously generated lens from the workpiece holder following the mounting of the previously generated lens to the lens-blocking device. Another aspect of the present invention relates to ascertaining the location of the lens-blocking device with respect to the workpiece holder.

The technique also preferably includes the step of applying a bonding material, such as wax or cement, to either the previously generated lens or the lens-blocking device prior to the mounting step. The workpiece holder and the lens-blocking device can be moved relative to one another so that the bonding material is compressed to a predetermined and uniform thickness between the previously generated lens and the lens blocking device. Given the known relationships of the various components, a point on the previously generated lens can then be at a known distance from a point on the lens-blocking device.

The first and second axes can be the same linear axis, and the third axis can be a linear axis perpendicular to the first and second axes. Alternatively, the first axis can be a rotary axis, and the second and third axes can be linear axes disposed perpendicular to one another. Any suitable arrangement is acceptable for purposes of the present invention. A toolholder may be moveable not only along a rotary axis, but also along a linear axis which is parallel or coincident with the second linear axis. The same can be said of the lens-blocking device.

The technique may also include removing a blocked arbor from the mounting fixture so that the blocked arbor can be used in a subsequent machining operation. A second arbor can be mounted in the mounting fixture so that a second previously generated lens can be blocked on the second arbor. The blocked arbor can be mounted in an apparatus for further machining.

An apparatus in accordance with the present invention preferably includes a workpiece holder, a toolholder and a lens-blocking device, the toolholder being moveable along a first axis, the lens-blocking device being moveable on a second axis and the workpiece holder being moveable along a third axis which can traverse said first axis and said second axis. The workpiece holder and the toolholder can be moved relative to one another so that a tool can machine a workpiece to form a previously generated lens, and the workpiece holder and the lens-blocking device can be moved relative to one another so that the previously generated lens can be mounted or blocked to the lens-blocking device. The movement of the respective components can be such that the previously generated lens can be mounted to the lens-blocking device prior to releasing the previously generated lens from the workpiece holder. Means for releasing the previously generated lens from the workpiece holder is also preferably included.

The apparatus may further include a tool-setting mechanism for locating the lens-blocking device at a known or determinable position with respect to the workpiece holder. Means for aligning the rotational axis of the previously generated lens with the centerline axis of the lens-blocking device can also be provided.

As in the foregoing, the first and second axes may be the same linear axis, and the third axis may be a linear axis disposed perpendicular to the first and second axes. The first axis may be a rotary axis, and the second and third axes may be linear axis which are arranged perpendicular to one another. Again, any suitable arrangement will suffice. The toolholder may be moveable along a linear axis which is parallel or coincident with the second linear axis, and the lens-blocking device may also be moveable along the first rotary axis.

The apparatus may further include an application device for applying a bonding material to either the previously generated lens or the lens-blocking device prior to the mounting step. The workpiece holder and lens-blocking device may be so constructed and arranged that the bonding material can be compressed to a predetermined and uniform thickness between the previously generated lens and the lens-blocking device. Accordingly, a point on the previously generated lens is at a known distance from a point on the lens-blocking device.

The lens-blocking device may be an arbor removably disposed in a mounting fixture. The mounting fixture may include an adjustable endstop so that arbors of different lengths may be accommodated. Additionally, the mounting fixture may include a height adjustment for adjusting the arbor in a direction perpendicular to a plane formed by the first, second and third axes. A pitch adjustment may also be provided to adjust the centerline axis of the arbor to be parallel with the third axis.

The present invention may also be met by a technique including the steps of forming a previously generated lens, mounting the previously generated lens on a lens-blocking device while the previously generated lens is still in the workpiece holder, and releasing the previously generated lens from the workpiece holder. This technique may further include the step of aligning the previously generated lens with the lens-blocking device prior to the mounting step. This alignment may include the alignment of the rotational axis of the previously generated lens and the centerline axis of the lens blocking device. The further step of determining the respecting positions of the previously generated lens and the lens blocking device may also be included in the technique. The alignment step may be based on the determination of the respective positions.

An apparatus in accordance with the present invention may also include a workpiece holder, a toolholder and a lens-mounting device, whereby the workpiece holder and the toolholder are moveable relative to one another so that a tool held by the toolholder can perform a machining operation on a workpiece held by a workpiece holder, resulting in the formation of a previously generated lens, and the workpiece holder and the lens-blocking device may be moveable relative to one another so that the previously generated lens can be mounted on a lens-blocking device while the previously generated lens is still being held by the workpiece holder. Such an apparatus might also include release means for releasing the previously generated lens from the workpiece holder after the previously generated lens is mounted on a lens-blocking device.

This apparatus may further include alignment means for aligning the previously generated lens with the lens-blocking device prior to mounting the previously generated lens on the lens-blocking device. Once again, this alignment may include alignment of the rotational axis of the previously generated lens and the centerline axis of the lens-blocking device.

A tool-setting mechanism may also be included for ascertaining the respective positions of the previously generated lens and the lens-blocking device. The workpiece holder and the lens-blocking device may be moveable based on the ascertained positions.

BRIEF DESCRIPTION OF THE DRAWINGS

The above objects, features and advantages of the present invention will become more apparent, as will a better understanding of the concepts underlying the present invention, by reference to the detailed description which should be taken in conjunction with the accompanying drawings, wherein.

DETAILED DESCRIPTION OF THE DRAWINGS

Figure 1:
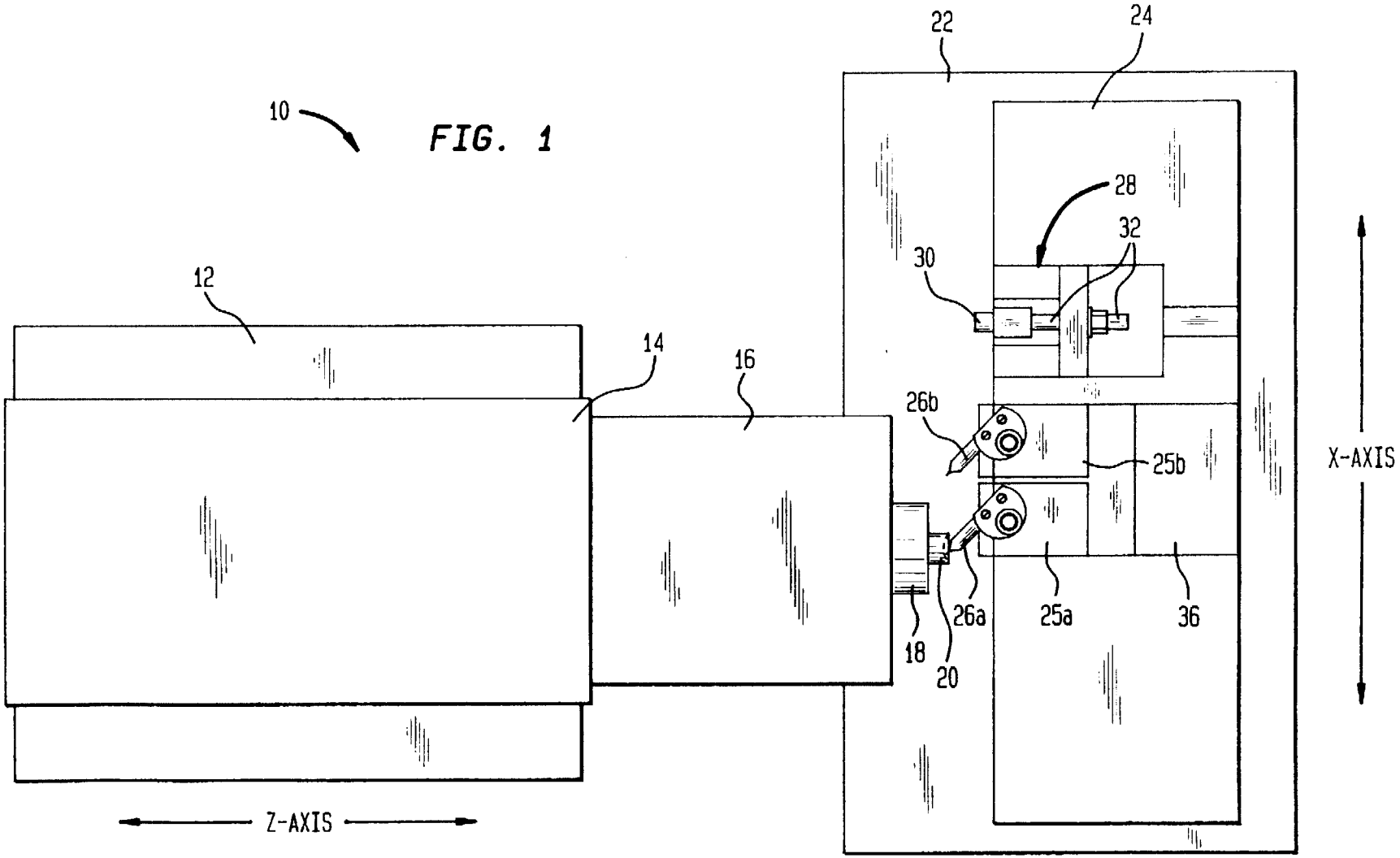
FIG. 1 is a schematic representation, in plan view, of a multi-axis lens generating device with on-machine (in-situ) blocking capabilities, illustrating in particular the formation of a previously generated lens.
Figure 2:
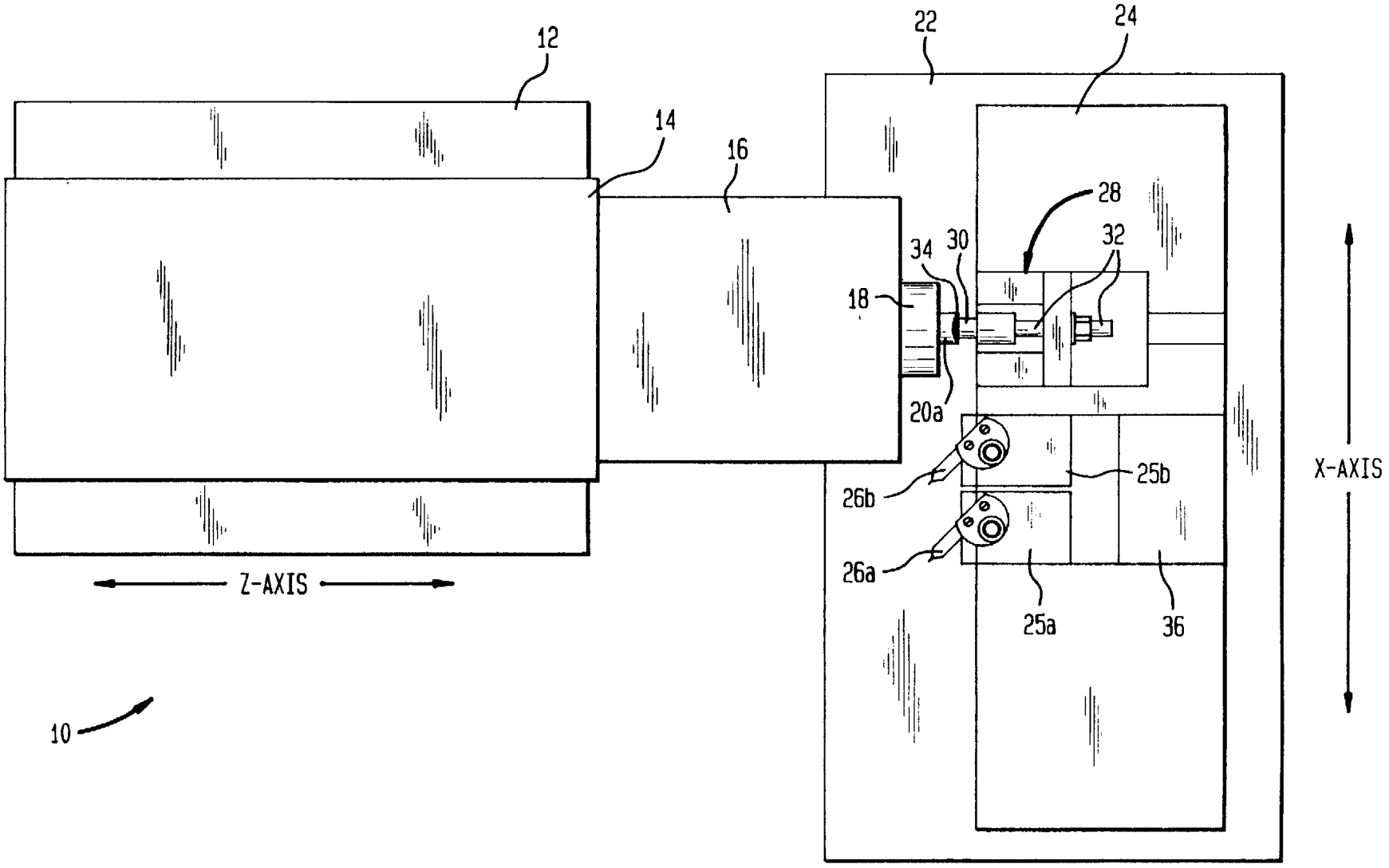
FIG. 2 is a schematic representation, in plan view, of the multi-axis lens generating machine of FIG. 1, illustrating the blocking of a previously generated lens on a blocking arbor mounted in an in-situ blocking fixture.

Referring to the figures, FIGS. 1 and 2 schematically illustrate a two axis lathe, generally designated as 10 in accordance with the present invention. (The disclosure of the two axis lathe 10 is illustrative only, since the concepts and principles underlying the present invention are applicable to any machining device having more than one axis—linear or otherwise.) The lathe 10 is a computer numerically controlled (CNC) lathe, which employs computer software to facilitate the machining and blocking operation. The Z-axis slide support 12 carries a Z-axis slide 14 which is moveable linearly along the Z-axis. The Z-axis slide 14 carries a spindle 16, which rotates a chuck 18 and a workpiece held by the chuck. (For purposes of the discussion herein only, the workpiece is a lens blank 20 from which a contact lens can be machined.) The spindle 16 includes a longitudinal axis which is parallel with the Z-axis motion and which is coincident with the rotational axis of the lens blank 20.

The lathe 10 also includes an X-axis slide support 22 on which the X-axis slide 24 is moveable linearly along the X-axis, which is perpendicular to the Z-axis. The X-axis slide 24 has mounted thereon at least one toolholder. In FIGS. 1 and 2, two toolholders **25*a* and 25*b* are illustrated. These toolholders hold cutting tools 26*a* and 26*b*. In general, a two axis lathe of the type shown in FIGS. 1 and 2 can include one or several cutting tools, depending upon the operations to be conducted on the workpiece. There are cutting tools to perform rough cuts, finish cuts and edge cuts; including concave cuts on the front of the lens blank 20, convex cuts on the back side of the lens blank 20**, and even reference diameter line cuts (which have sometimes been used to facilitate the blocking of a previously generated lens on a separate fixture).

The two axis lathe 10 also includes a supplemental manual axis to be considered in the machining process. This supplemental axis is known as the Y-axis, and it is perpendicular to the X-axis and Z-axis. It is the vertical component in the system described herein.

Typically, a lens blank 20 is machined by positioning the cutting tool **26*a* or 26*b* relative to the lens blank 20 such that the tip of the cutting tool is in contact with the workface of the lens blank 20. The Z-axis slide 14 and the X-axis slide 24 move in coordinated motions so that the cutting tip moves horizontally across the workface of the workpiece 20**. This operation is known as continuous path contouring. Successive sweeps of the cutting tip across the workface removes material until the desired profile is attained.

In FIG. 1, the cutting tip of cutting tool **26*a* is shown machining a concave surface in the workface of the lens blank 20. To precisely machine a lens blank 20 when forming a previously generated lens or other component, the position of the cutting tip of the cutting tool with respect to the rotational axis of the spindle 16 (and thus the rotational axis of the lens blank 20) and the workface of the lens blank 20 should be known. Several techniques might be used to position and monitor the tip of the cutting tool with reference to the lens blank 20. U.S. Pat. No. 5,272,818 discloses a technique to ascertain and monitor the tip of the cutting tool (often an apex since a slight radius is typically present on the cutting tip of a cutting tool). The disclosure in U.S. Pat. No. 5,272,818 is incorporated herein. The information gathered from the tool-setting mechanism is used by the computer software (together with other information relating to the lathe and its components) to position the X-axis and Z-axis slides so that the tool can accurately machine the lens blank 20**. This machining operation can be accomplished in any suitable conventional manner.

Figure 3:
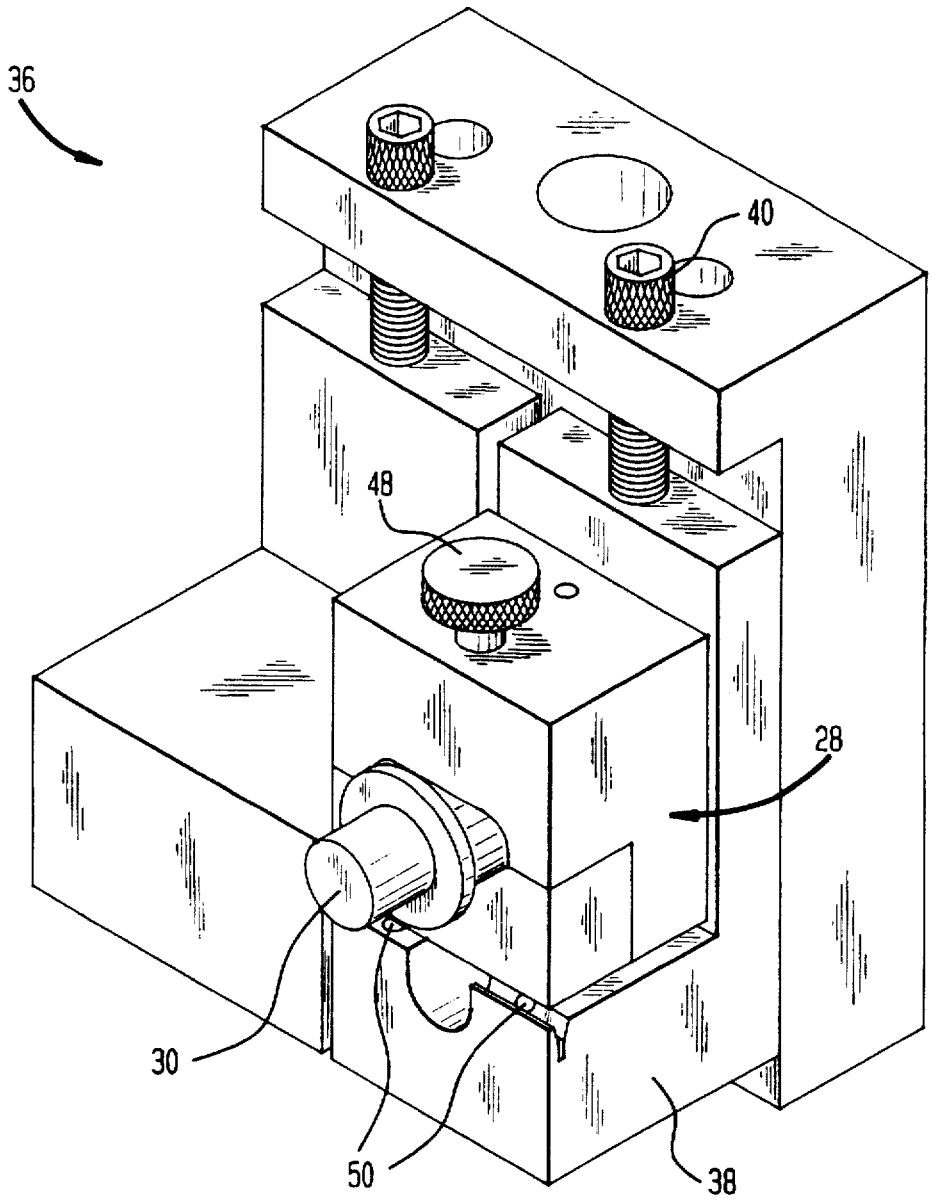
FIG. 3 is an isometric view of a blocking fixture in accordance with the present invention.
Figure 4:
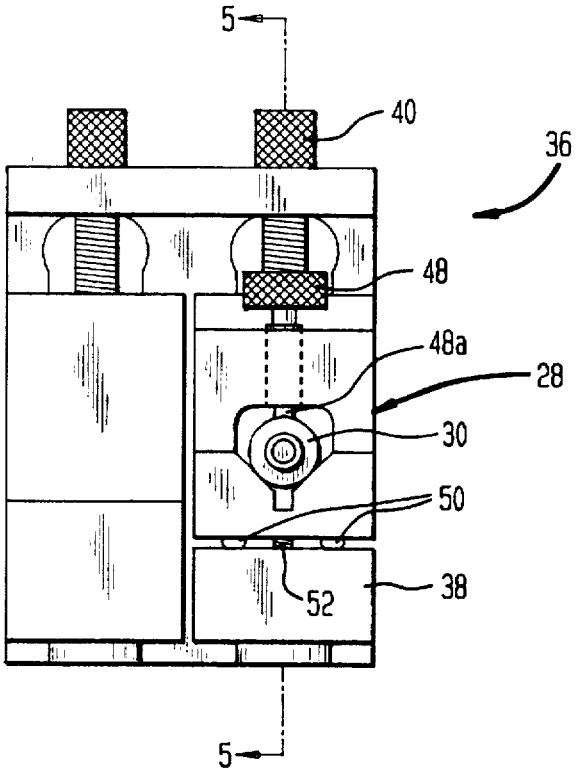
FIG. 4 is a front elevational view of a blocking fixture in accordance with the present invention.
Figure 5:
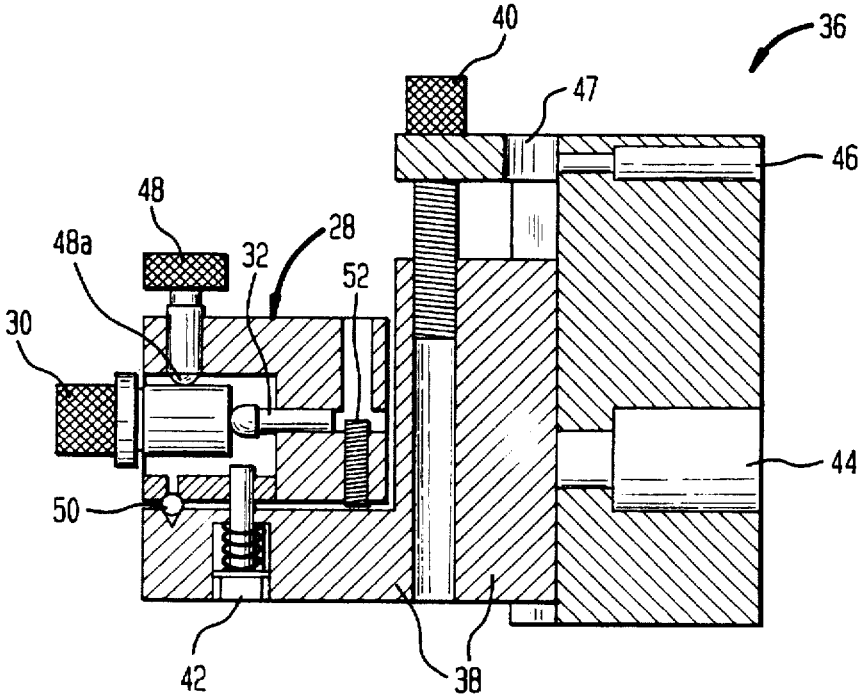
FIG. 5 is a cross-sectional view of the blocking fixture in FIG. 4, as taken on line 5—5 of FIG. 4.

The X-axis slide 24 of the lathe 10 also includes a blocking fixture 28 which holds a blocking arbor 30 and an adjustable endstop 32. Preferably, these components take little space on the lathe. The endstop 32 is adjustably moveable along an axis parallel to the Z-axis so that arbors of different lengths can be used in the blocking fixture 28. The blocking surface of the arbor 30 may be shaped to match the profile of the base curve of the lens to be blocked on the arbor 30. The arbor 30 may also include a collar, as shown in FIGS. 3–5, which may facilitate the positioning of the arbor 30 in a holding fixture, such as a collet. The collar may provide a reference point, which is useful as explained below.

In the preferred embodiment, the blocking fixture 28 and the arbor 30 are fixed to the X-axis slide 24 at a known or determinable X offset position. Once again, the tool-setting technique in U.S. Pat. No. 5,272,818 can be used to establish this X offset position, and in general to set the arbor 30 with respect to the centerline of the workpiece holder and spindle. In the preferred embodiment, this X offset position is the X distance between the cutting tip of the last tool to be used to perform a machining operation on the workpiece 20 and the centerline of the blocking arbor. For example, in FIG. 1, the tool **26*a* may be a cutting tool for roughly cutting the concave surface in the lens block 20, while the tool 26*b* is subsequently used to finish machine such concave surface. Thus, the tool 26*b* may be the last tool used in forming the previously generated lens from the lens blank 20. Therefore, the centerline of the arbor 30 will be at a known distance from the cutting tip of the cutting tool 26*b***.

Following the machining of the lens blank 20 to produce a previously generated lens (generally designated as **20*a* in FIG. 2), the Z-axis slide 14 is moved away from the cutting tools 26*a* and 26*b*. As shown in FIG. 2, the X-axis slide 24 is moved to align the axis of the spindle 16 and optical axis of the previously generated lens 20*a* with the centerline of the arbor 30. Wax, cement or any other suitable bonding material, generally designated as 34 in FIG. 2, is placed on the arbor 30 in preparation for receiving the previously generated lens 20*a*. This is accomplished in any known manner, which may include heating the wax. The Z-axis slide 14 is then moved forward to engage the previously generated lens 20*a* against the wax or cement 34 on the arbor 30. The Z-axis slide 14 is moved toward the arbor 30 to compress the wax or cement 34, but without permitting the previously generated lens 20*a* to contact the arbor 30. Depending upon the wax, cement or other means for holding the previously generated lens 20*a* on the arbor 30, the Z-axis slide 14** may dwell in the blocking position until the wax or cement hardens or at least partially hardens.

Once the previously generated lens **20*a* is mounted or blocked on the arbor 30, and the wax or cement 34 has solidified enough to hold the previously generated lens 20*a* accurately to the arbor 30, the chuck 18 can unclamp the previously generated lens 20*a*. Thereafter, the Z-axis slide 14 is moved away from the arbor 30 to leave the previously generated lens 20*a* in the blocked position on the arbor 30**.

Following the blocking procedure, the blocked arbor 30 (i.e., the arbor 30 with the blocked previously generated lens **20*a*) can be removed from the blocking fixture 28 and used to hold the previously generated lens 20*a* during further machining operations. Since the optical axis of the previously generated lens 20 is coincident with the centerline axis of the arbor 30, and the position of the apex of the base curve of the previously generated lens 20*a* is in a known length position vis-a-vis the arbor 30 or a reference point thereon, all subsequent operations can be undertaken based on the axis and reference point of the arbor 30. The fixture for holding the blocked arbor 30 in subsequent operations will use the outside diameter and the reference point to properly hold the blocked arbor 30**.

The arbor 30 can be loaded or unloaded manually, or fully integrated into a completely automated manufacturing process, whereby remote auto loading devices can be used to load arbors before blocking and remove arbors after blocking together with the blocked lens.

As the above suggests, another aspect of the present invention relates to precisely positioning the apex of the previously generated lens **20*a* with respect to a reference point on the arbor 30. The reference point can be any suitable point on the arbor 30, since the blocked arbor 30 will be removed and used to perform subsequent machining or mechanical operations on the previously generated lens 20*a*. The relationship between the reference point and the front face of the arbor 30, on which the previously generated lens 20*a* will be blocked, is known. Knowing this relationship, the Z offset position of the arbor 30 can be ascertained in any conventional manner, preferably in the same manner in which the X offset and Y offset positions were ascertained. As indicated above, the X, Y and Z offset positions are preferably determined or identified in the same manner in which the cutting tools were set. Thus, the tool-setting mechanism in U.S. Pat. No. 5,272,818 may be used to determine these offset positions. With respect to the Z offset position, such tool-setting mechanism can be used to determine the position of the reference point on the arbor 30 with respect to the base curve of the previously generated lens 20*a***.

Since the depth of the base curve is known, Z-axis slide 14 can be moved forward to compress the wax or cement 34 to a uniform thickness. This eliminates surface probing of the previously generated lens **20*a* when machining the convex side of the lens. Therefore, the uniform thickness of the wax or cement 34 facilitates the machining of a lens having a consistent center thickness and edges which are concentric to the optical axis. Moreover, because the position of the apex is known, the thickness of the wax or cement 34 can be controlled by the operator. The operator can specify the requisite thickness within the software controlling the movement of the various components of the lathe 10**.

The specific structure and features of the blocking fixture 28 can be seen more clearly in FIGS. 3–5. FIG. 3 is an isometric view of the blocking fixture 28 which is part of a larger toolholding fixture 36. The relationship of the blocking fixture 28 to the larger toolholding fixture 36 can also be seen in FIGS. 4 and 5. FIGS. 4 and 5 also clearly show that the larger toolholding fixture 36 can hold two blocking fixtures 28, although only one is shown in these figures. The larger toolholding fixture 36 is attachable to the X-axis slide 24 by bolts or any other suitable means. It may also include cutting tools such as those shown at **26*a* and 26*b***.

The blocking fixture 28 is attached at its bottom to a height-adjusting structure 38 which includes a fine adjustment screw 40 for fine vertical adjustment of the arbor 30. A spring-loaded bolt 42 is disposed within the height-adjusting structure 38 and releasably attaches the blocking fixture 28. Also associated with the vertical adjustment of the blocking fixture 28 is a spring-loaded screw (not shown) which enters through the counter-bore 44 in the back of the large fixture 36. This spring-loaded screw terminates in a T-nut (not shown) which is slideably disposed in a T-shaped slot (not shown) in the height adjustment structure 38. This permits controlled vertical movement of the height-adjusting structure 38 and blocking fixture 28. The small counter-bore 46 is merely a locking screw hole to lock a dial indicator which can be placed in the opening 47. Such a dial indicator (not shown) can be used to indicate the height of the arbor 30 or any other portion of the adjusted structure.

The arbor 30 is disposed in a V-shaped slot where it rests on the vertical surfaces of the V shape. The arbor 30 is sized with respect to the V-shaped slot so that the centerline or axis of the arbor 30 is known when the arbor 30 is disposed in such slot. Spring-loaded bolt 48 maintains the arbor 30 in place in the V-shaped slot. For convenience, spring-loaded bolt 48 requires only a quarter turn to release or engage the arbor 30, and is thus a convenient expedient for inserting new arbors and removing arbors on which previously generated lenses have been blocked. The spring-loaded bolt 48 is shown in the engaged position, its tip 48*a* bearing against the top surface of the arbor 30 to maintain the arbor 30 in place within the V-shaped slot. The endstop 32, described above with regard to FIGS. 1 and 2, is also shown in FIG. 5, although it takes on a slightly different form than as shown in FIGS. 1 and 2.

The axis of the arbor 30 is maintained parallel to the spindle axis, and as indicated above, these axes are coincident when the previously generated lens 20*a* is blocked. Thus, because of tolerances within the manufacture of the various components which sit on the X-axis slide, including the slide itself, the blocking fixture 28 is provided with a pitch adjustment in addition to a height adjustment. Such pitch adjustment includes two balls 50 and a screw 52 arranged in a triangular pattern. Both balls 50 and the pitch adjustment screw 52 can be seen in FIG. 4, while one of the balls 50 and the screw 52 can be seen in FIG. 5. As is known in such kinematic systems, one of the balls is in a conical recess and the other ball is in a V-shaped recess, so that the kinematic system has some play and the adjustment is not over-constrained. This arrangement is shown in FIG. 3. To adjust the pitch of the axis of the arbor 30, the pitch-adjusting screw 52 is rotated to either raise the back of the blocking fixture 28 or lower the back of the blocking fixture 28. This pitch adjustment is continued until the axis of the arbor 30 is vertically parallel with the spindle axis or the axis of the previously generated lens 20*a*.

The height-adjusting screw 40 includes highly pitched screw threads for adjusting the height of the blocking fixture 28 and thus the arbor 30. This vertical adjustment is preferably accomplished during the set-up phase of the tooling operation. That is, the arbor 30 is set at the same time the cutting tools are set. As indicated above, this setting can be accomplished in any suitable manner, and one way of accomplishing the setting of the tools and the arbor is by using the technique disclosed in U.S. Pat. No. 5,272,818. Optical tool-setting mechanisms, tough trigger probes, and the prior tool-setting methods described in this patent or any other suitable method might also be used in connection with the setting of the tools and arbor in the present invention.

Figure 6A:
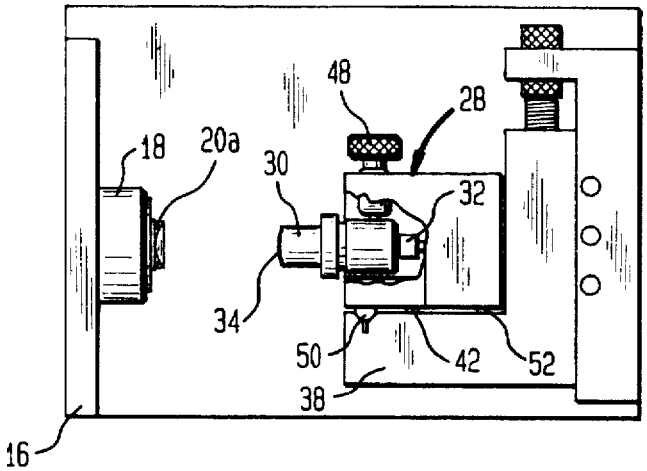
FIGS. 6A–6C are partial elevational views of the workpiece holder and lens-blocking device, illustrating sequentially the manner in which a previously generated lens is blocked.
Figure 6B:
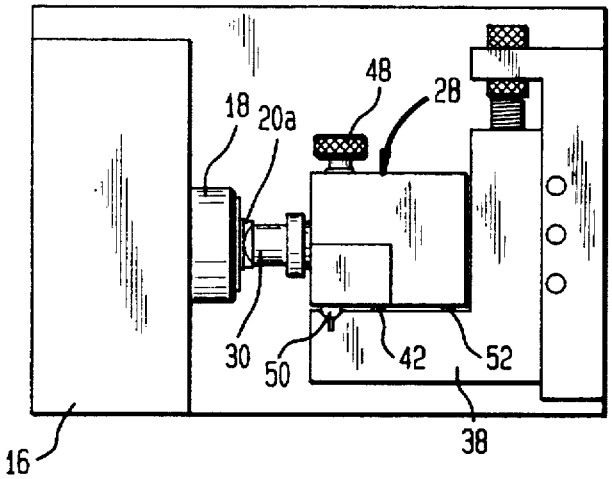
Figure 6C:
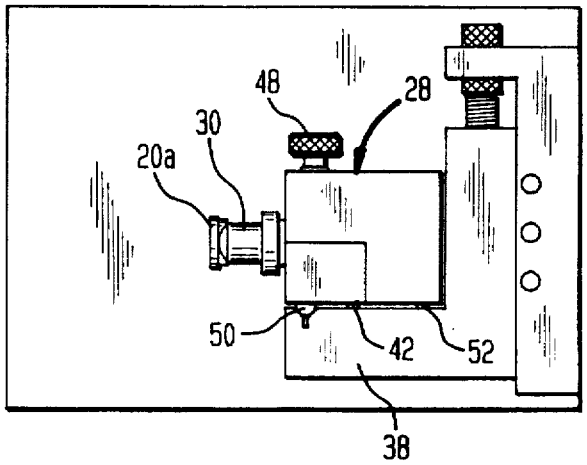

FIGS. 6A–6C show more specifically the manner in which a previously generated lens 20*a* is blocked on an arbor 30. In FIG. 6A, the rotational axis of the spindle 16, and thus the workpiece holder 18 and previously generated lens 20*a* is aligned to be coincident with the centerline axis of arbor 30. In FIG. 6B the previously generated lens 20*a* is shown contacting the wax or cement 34 on the arbor 30. As indicated above, the spindle 16 is moved forward to compress the wax or cement 34 to a predetermined and uniform thickness. The wax or cement 34 is allowed to at least partially harden or solidify. Preferably, the hold-down screw 48 is released, and the spindle 16 is moved away from the mounting fixture 28, pulling with it the arbor 30. At that time, the workpiece holder 18 releases the previously generated lens 20*a*, which is now blocked on the arbor 30. The purpose for releasing a hold-down screw 48 and backing off the spindle 16 is that some collets on spindles actually push a workpiece forward slightly during the releasing action. Thus, if the arbor 30 is held by the hold-down screw 48 against the endstop 32 during this release, the bond between the previously generated lens 20*a* and arbor 30 may be disturbed, with the possibility of disturbing the alignment between these components. As can be seen in FIG. 6, the rotational axis of the previously generated lens 20*a* is coincident with the centerline axis of the arbor 30.

The lathe 10 thus includes the lens generating equipment, as well as the blocking fixture. The same axes which facilitated the machining of the workpiece are used to facilitate the blocking of the partially finished workpiece (or finished workpiece) on an arbor for use in subsequent machining or mechanical operations. Thus, the inherent accuracies of the multi-axis lens generating equipment are used to block the workpiece.

In use, the lens blank 20 would be mounted in the chuck 18, such that the axis of the lens blank 20 is coincident with the axis of the spindle 16 which will rotate the lens blank 20. A tool-setting mechanism of the type described in U.S. Pat. No. 5,272,818 could then be used to set up the cutting tools 26. The position of the tools 26 and the position of the lens blank 20 will be stored in computer software. The same tool-setting technique can be used to establish the X, Y and Z offset positions of the arbor 30. These parameters are also stored in the computer software so that the system always knows or can always ascertain the position of each of the various components with respect to one another. The operator then commences the part-cutting cycle, providing the computer software with the requisite information for the part being machined. The computer software thus causes the X-axis slide 24 and the Z-axis slide 14 to move relative to one another based on the known relative positions of the lens blank 20 and the tools 26. A base curve is machined into the lens blank 20 to form a previously generated lens 20*a*. In this case, the previously generated lens 20*a* is a partially finished lens since the power curve must be established in a subsequent machining operation.

The software then moves the previously generated lens 20*a* to the blocking fixture 28. Wax or cement 34 are applied to the arbor 30 and the Z-axis slide is moved forward until the previously generated lens 20*a* compresses the wax or cement 34 to a predetermined uniform thickness. The result of this blocking technique is that the alignment of the optical axis of the previously generated lens 20*a*, the centerline axis of the arbor 30, reference surfaces and edges are all held very accurately to one another. The blocked arbor 30 can now be removed from the blocking fixture 28 and delivered for subsequent machining in which the arbor will be fixed in a chuck, collet or other suitable holding fixture.

Figure 7:
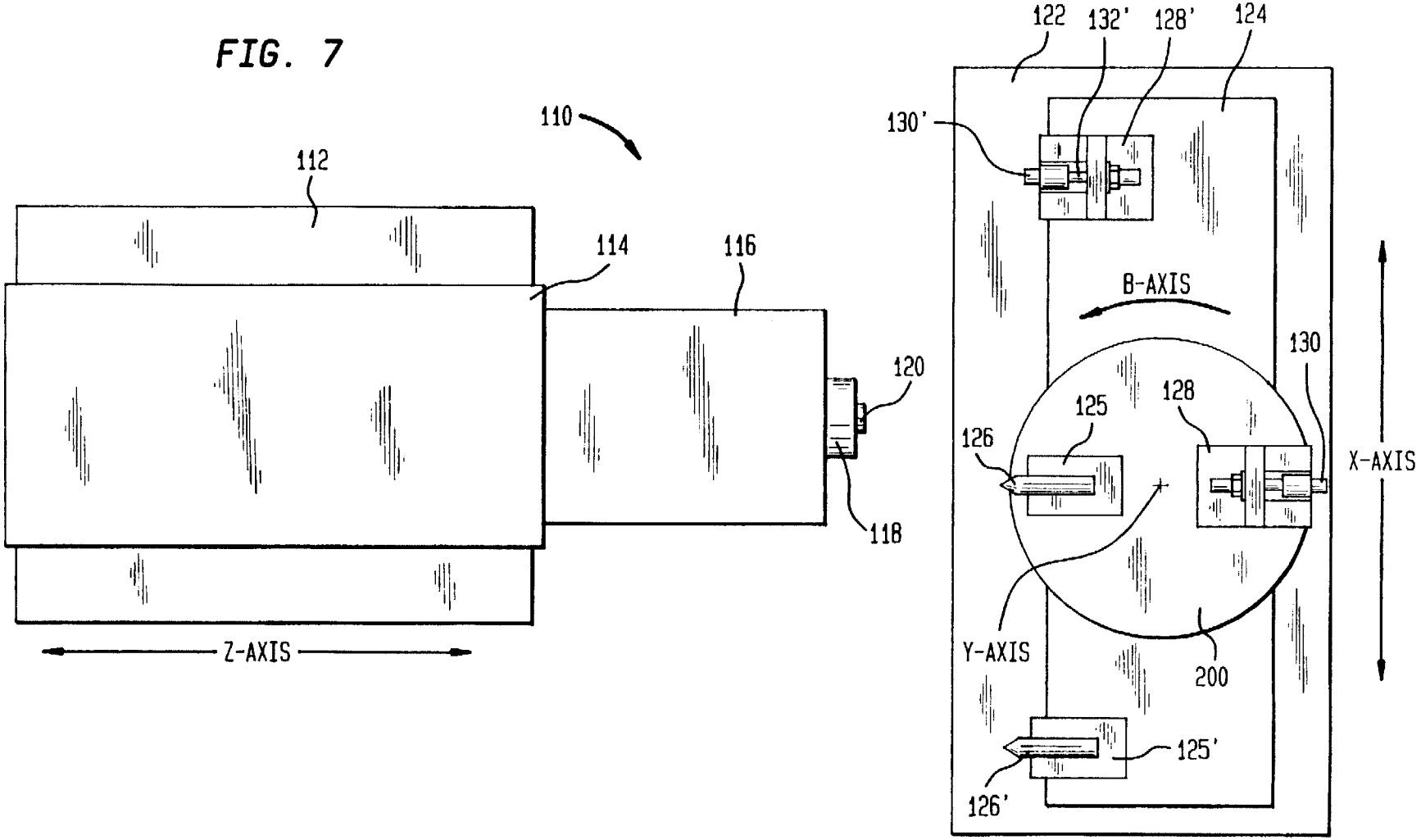
FIG. 7 is a schematic representation, in plan view, of a multi-axis lens generated device with in-situ blocking capabilities, illustrating in particular a multi-axis lens generating device having a rotary axis for moving a toolholder and/or a blocking arbor.

As indicated above, and is clear from the foregoing description, the concepts underlying the present invention are also applicable to lens generating equipment other than the two axis lathe described above. FIG. 7 shows another example of a lathe in accordance with the present invention. It includes a rotary axis for moving a tool holder and/or a blocking fixture in an arcuate path. Thus, FIG. 7 shows a lathe, generally designated as 110, which includes not only an X-axis and a Z-axis, but also a B-axis. The B-axis is a rotary axis which rotates about an axis which is parallel to or coincident with the Y-axis or vertical component of the system. For illustrative purposes, the Y-axis is shown in FIG. 7 as the point about which the toolholder and blocking fixture rotate.

Along the Z-axis, the lathe 110 includes the Z-axis slide support 112, the Z-axis slide 114, the spindle 116, the chuck or collet 118, and, when in use, the workpiece or lens blank 120. An X-axis slide support 122 is provided with an X-axis slide 124 moveable thereon. Movement along the B-axis or rotary axis is facilitated by the B-axis table 200. It carries a toolholder 125 and a tool 126, as well as a blocking fixture 128, arbor 130 and adjustable endstop 132.

In operation, it is contemplated that the X-axis, Z-axis and B-axis components will move to work on the lens blank 120 to form a previously generated lens. To accomplish this, the B-axis table 200 may be rotated in an arcuate path, whereby the tool 126 would sweep across the workface of the lens blank 120. Once the previously generated lens is prepared, the B-axis table 200 can be rotated so that the centerline of the arbor 130 is in alignment with the centerline of the spindle 116, and thus the optical axis of the previously generated lens. Blocking can then occur as explained above.

Alternatively, FIG. 7 also shows a toolholder 125', a tool 126', a blocking fixture 128', an arbor 130' and an adjustable endstop 132' mounted on the X-axis slide 124 for movement along the X-axis. A multi-axis lathe may thus include only a toolholder 125 and associated cutting tool 126 on the B-axis table, while a blocking fixture 128' and arbor 130' are provided along the X-axis. Another toolholder 125' and associated tool 126' can also be provided on the X-axis. The lathe 110 might then operate to machine a surface on the lens blank 120 with the tool 126', and then to further machine the lens blank 120 with tool 126, using the rotary motion along the B-axis. Thereafter, the previously generated lens machined by the cutting tools 126 and 126' could be blocked on arbor 130'.

This last embodiment is shown to illustrate that any suitable combination of components along any suitable axes are possible and are contemplated by the present invention.

While the foregoing description and figures illustrate a preferred embodiment of the in-situ blocking method and apparatus in accordance with the present invention, it should be appreciated that certain modifications can be made and are encouraged to be made in the components, equipment and techniques in the disclosed preferred embodiment without departing from the spirit and scope of the present invention, which is intended to be captured by the claims set forth immediately below.

What is claimed is:

1. A method of blocking a previously generated lens comprising the steps of:

a. providing a machining device having a workpiece holder holding a workpiece, a toolholder holding a tool for performing a machining operation on the workpiece, and a lens-blocking device, wherein the toolholder is moveable along a first axis, the lens-blocking device is moveable along a second axis, and the workpiece holder is moveable along a third axis which can traverse the first axis and the second axis;

b. moving the workpiece holder and the toolholder relative to one another so that the tool machines the workpiece to form a previously generated lens; and c. moving the workpiece holder and the lens-blocking device relative to one another so that the previously generated lens becomes mounted to the lens-blocking device.

2. The method in claim 1, wherein the mounting step is accomplished prior to releasing the previously generated lens from the workpiece holder, and further including the step of releasing the previously generated lens from the workpiece holder, whereby the previously generated lens is mounted on the lens-blocking device for subsequent operations.

3. The method in claim 2, wherein the lens-blocking device is located at a known or determinable position with respect to the workpiece holder.

4. The method in claim 2, further including the step of applying a bonding material to either the previously generated lens or the lens-blocking device prior to the mounting step, whereby the bonding material facilitates the mounting of the previously generated lens to the lens-blocking device.

5. The method in claim 4, wherein the workpiece holder and the lens-blocking device are moved relative to one another so that the bonding material is compressed to a uniform thickness between the previously generated lens and the lens-blocking device, and so that a point on the previously generated lens is at a known distance from a point on the lens-blocking device.

6. The method in claim 2, further including the step of ascertaining the position of the lens-blocking device relative to the workpiece, and wherein the mounting step includes first aligning the rotational axis of the previously generated lens with the centerline axis of the lens-blocking device.

7. The method in claim 2, wherein the first axis and the second axis are the same linear axis and the third axis is a linear axis disposed perpendicular to the first and second axes.

8. The method in claim 1, wherein the first axis is a first rotary axis, the second axis is a second linear axis and the third axis is a linear axis which is perpendicular to the second linear axis.

9. The method in claim 8, wherein the toolholder is also moveable along a linear axis which is parallel or coincident with the second linear axis.

10. The method in claim 9, wherein the lens-blocking device is also moveable along the first rotary axis.

11. The method in claim 1, wherein several toolholders and tools are provided, and the step of moving the workpiece holder and the toolholder relative to one another includes moving the workpiece holder and several toolholders relative to one another so that several tools machine the workpiece to form the previously generated lens.

12. The method in claim 1, wherein the mounting step includes moving the workpiece holder and the lens-blocking device relative to one another so that a point on the previously generated lens is at a known distance from a point on the lens-blocking device, and so that the rotational axis of the previously generated lens is coincident with the centerline axis of the lens-blocking device.

13. The method in claim 1, wherein the lens-blocking device is an arbor disposed in a mounting fixture, the arbor being a blocked arbor following the mounting of the previously generated lens on the arbor, and further including the step of removing the blocked arbor from the mounting fixture to use the blocked arbor in a subsequent machining operation.

14. The method in claim 13, further including the step of mounting a second arbor in the mounting fixture so that a second previously generated lens can be blocked on the second arbor.

15. The method in claim 13, further including the step of mounting the blocked arbor in an apparatus so that the previously generated lens can undergo a further machining operation.

* * * * *